United States Patent [19]

Wright

[11] Patent Number: 4,597,861

[45] Date of Patent: Jul. 1, 1986

[54] SPIRAL SEPARATOR

[75] Inventor: Douglas C. Wright, Terranora, Australia

[73] Assignee: Mineral Deposits Limited, Queensland, Australia

[21] Appl. No.: 684,922

[22] PCT Filed: Apr. 12, 1984

[86] PCT No.: PCT/AU84/00058

§ 371 Date: Dec. 7, 1984

§ 102(e) Date: Dec. 7, 1984

[87] PCT Pub. No.: WO84/04058

PCT Pub. Date: Oct. 25, 1984

[30] Foreign Application Priority Data

Apr. 13, 1983 [AU] Australia ..... PF8850

[51] Int. Cl.[4] ..... B03B 5/52

[52] U.S. Cl. ..... 209/459

[58] Field of Search ..... 209/459, 460, 434, 3

[56] References Cited

U.S. PATENT DOCUMENTS

| | | | |
|---|---|---|---|
| 629,590 | 7/1899 | Pardee . | |
| 923,988 | 6/1909 | Mullen . | |
| 1,040,374 | 10/1912 | Middleton et al. . | |
| 1,462,618 | 10/1921 | Pardee . | |
| 1,698,101 | 1/1929 | Martling . | |
| 1,880,185 | 9/1932 | Kerns et al. . | |
| 2,425,110 | 8/1947 | McCurdy . | |
| 2,431,559 | 11/1947 | Humphreys . | |
| 2,431,560 | 11/1947 | Humphreys | 209/459 X |
| 2,615,572 | 10/1952 | Hodge . | |
| 2,700,469 | 1/1955 | Humphreys | 209/459 X |
| 3,014,588 | 12/1961 | McNutt | 209/434 |
| 3,099,621 | 7/1963 | Close . | |
| 3,319,788 | 5/1967 | Reichert . | |
| 3,371,784 | 3/1968 | Conway . | |
| 3,568,832 | 3/1971 | Persson . | |
| 3,891,546 | 6/1975 | Humphreys . | |
| 3,910,835 | 10/1975 | Stafford . | |
| 4,059,505 | 11/1977 | Bryson . | |
| 4,142,965 | 3/1979 | Dolan . | |
| 4,146,137 | 3/1979 | Beckham . | |
| 4,183,806 | 1/1980 | Giffard | 209/459 |
| 4,189,378 | 2/1980 | Wright et al. . | |
| 4,277,330 | 7/1981 | Wright et al. . | |
| 4,324,334 | 4/1982 | Wright et al. . | |
| 4,384,650 | 5/1983 | Wright . | |
| 4,476,980 | 10/1984 | Giffard . | |

FOREIGN PATENT DOCUMENTS

| | | | |
|---|---|---|---|
| 222598 | 7/1959 | Australia | 209/459 |
| 1132511 | 7/1962 | Fed. Rep. of Germany . | |
| 755308 | 7/1978 | U.S.S.R. | 209/459 |

*Primary Examiner*—Frank W. Lutter
*Assistant Examiner*—Thomas M. Lithgow
*Attorney, Agent, or Firm*—Stevens, Davis, Miller & Mosher

[57] ABSTRACT

In wet gravity separation of solids according to specific gravity an outer depleted band partly overlies an inner concentrate band limiting yield and/or purity of separated concentrate. The overlying depletion layer is diverted outwardly from inner wall (15) relative to the concentrate band. Deflection means (20) cause a bow wave in descending slurry which fans out the concentrate aiding precise setting of downstream splitter blade (18) as well as diverting the overlying depletion band towards outer wall (13). The water which has become separated from the slurry due to centrifugal force can be rehomogenized with the remaining concentrate by restricted passage between deflector means (22,26).

13 Claims, 7 Drawing Figures

SPIRAL SEPARATOR

TECHNICAL FIELD

This invention relates to spiral separators. Spiral separators are used extensively for the wet gravity separation of solids according to their specific gravities. For examples, spiral separators are used in separation of various kinds of mineral sands from silica sands, and in cleaning crushed coal by the removal of ash or other impurities. An example of such a spiral separator is described in pending Australian patent application No. 55205/80.

BACKGROUND ART

Separators of the kind under discussion have a helical trough or sluice which has an inner wall and an outer wall connected by a floor. In use, a pulp or slurry containing species to be separated is fed to the trough. The species in the slurry are sorted according to size and specific gravity with the largest and/or heaviest species moving to one side of the stream and the finer and/or lighter species being distributed in layers from the bed of the stream upwardly and from the inside of the curve outwardly and with water piling up on the outside of the bend. When the gravitational force is greater than the centrifugal force the largest and/or heaviest species are concentrated in a band near the inner wall ("concentrate band") and/or the finer and lighter species move towards the outer wall forming a band of depleted concentrate ("depleted band"). A splitter is arranged to remove the concentrate band via a take-off opening and the separation may be repeated on the depleted band.

DISCLOSURE OF THE INVENTION

While spirals of this general type have proved highly valuable, problems do arise in their operation in practice. Firstly, it has been observed that when the lighter and finer species (for example silica sand or other gangue) of the slurry has a very fine particle size, comparable with the particle size of the more dense material to be separated, some of the lighter species will move inwardly toward the inner wall of the spiral with the concentrate of the more dense species even though there is a very great difference in their respective specific gravities. In separating a mineral concentrate from silica sand, the presence of the silica sand can be observed as a band or layer which at least partially overlies the concentrate. This overlying depleted band or layer adversely affects the yield and/or grade of the concentrate which can be recovered from the slurry.

Secondly, a recent trend has been to operate such spirals without the addition of wash water as the pulp flows down the spirals. It has been observed that, with spirals having a large pitch and/or floors with a relatively large inclination to the horizontal in the trough longitudinal direction, the water in the pulp rapidly moves outwardly towards the outer walls of the spiral under centrifugal action and the remaining concentrate and gangue in the pulp quickly become sluggish as they flow down the spirals.

It is an object of the present invention to provide a method of, and apparatus for, overcoming or at least ameleorating those disadvantages and which in preferred embodiments improves the yield and/or grade of the concentrate obtainable from a spiral separator.

Methods according to the invention achieve the first object by the step of diverting the overlying remainder band or layer outwardly from the underlying concentrate at a location upstream of a concentrate take-off.

In a preferred embodiment a slurry deflector is situated inwardly of the remainder band. The shape of the deflector and the velocity of the slurry are selected so that a "bow wave" is produced which urges the overlying band outwards. The deflection means will also serve to fan out the width of the concentrate band in addition to diverting the overlying remainder band outwards relative thereto, the widened concentrate band facilitating setting by an operator of take-off splitters to obtain optimum grade and/or yield.

It is another object of the invention to provide a method of and apparatus for repulping the remainder band with water to maintain the flow of the tailings down the spiral and to enable any remaining concentrate in the pulp to be separated out of the pulp.

As herein used the terms "pulp" and "slurry" are interchangeable. An "outwardly" direction is a direction towards the outer wall of the trough and an "inwardly" direction is a direction towards the inner wall of the trough. "Concentrate" is the portion of the pulp or slurry that contains the mineral sought, a term well known and used as such in the art.

The number of turns, pitch and floor angle of the spirals may be selected to suit the particular mixture of mineral sand to be separated and the spirals may be provided with an inner gutter provided between the column and the inner wall, to receive and convey the concentrate taken out of the pulp at the various take-offs in the spiral. The take-offs may be of any suitable type, for example the type disclosed in Australian Pat. No. 522,914 having a transverse slot, or may include slots or discontinuities in the inner wall leading to the inner trough, and fixed or movable splitter blades may be provided to direct the concentrate through the take-offs. Preferably the deflection means are provided approximately 50–200 mm upstream of the take-offs and they may be provided on any or all of the turns of the spiral. However it is preferred that they are provided on every second turn of the spiral to enable the pulp to reach a deflection velocity before impinging on the deflection means. The 'deflection velocity' is the velocity at which it is observed that for example the silica sand (or gangue) is deflected outwardly from the inner wall of the spiral by a 'bow wave' created by the deflection means.

The deflection means may be fixed in, on or adjacent the inner wall of the spiral or may be movable relative thereto and the deflection means may be concealed in a recess formed in the inner wall to allow an unimpeded flow of the pulp down the spiral when not required. For the separation of high grade mineral, where no gangue or silica overlies the inner portion of mineral stream, the deflection means may be spaced from the inner wall to allow the portion of the mineral flow to be umimpeded, the deflection means operating to deflect the gangue or silica from the outer portion of the mineral flow. The deflection means may include a blade, finger or other formation which extends upwardly from the floor, or which has a slot or aperture adjacetn the floor which allows the band of concentrate to flow unimpeded down the spiral but where the overlying band or layer of silica is deflected outwardly.

According to a first aspect the invention consisits in a spiral separator for an aqueous slurry of species of varying sizes or specific gravities or both having a helical trough including an inner wall and, an outer wall connected by a floor and having at least one take-off opening for a concentrate species separated from a remainder, said separator including deflection means arranged upstream of said take-off opening so that a band of remainder which in use of the separator at least partially overlies a concentrate band is diverted in an outward direction relative to the concentrate band.

According to a second aspect the invention consists in a slurry containing a method for separating a first species from a second species having a specific gravity less than the first species comprising the steps of:

(a) feeding a slurry of the first and second species down the trough of a spiral separator having an inner wall and an outer wall connected by a floor whereby the slurry forms an inner band in which the first species is concentrated and an outer band in which it is depleted, at least a portion of said depleted outer band overlying the concentrated inner band, (b) diverting at least the inner part of the overlying depleted band outwardly relative to the underlying concentrate inner band at a location upstream from a opening; and (c) taking off said first species at said opening.

Preferably the restricted passage is defined between the spiral outer wall and an outwardly deflecting formation provided as a continuation of the inner wall of the spiral. Preferably, in addition, the outer wall is provided with an inwardly deflecting formation formed integrally with the outer wall.

A roof may be provided over the restricted passage to prevent the water being splashed or deflected out of the spiral, and the roof may have downwardly directed leading and/or trailing edges to deflect the water downwardly into the passage of restricted width to increase the remixing or repulping of the water and the tailings.

BRIEF DESCRIPTION OF THE DRAWINGS

By way of example only a preferred embodiment will now be described with reference to the accompanying drawings, in which:

FIG. 7 is a sectional side view of a roof section 27 shown in FIG. 1.

DESCRIPTION OF PREFERRED EMBODIMENT

Figure 1:
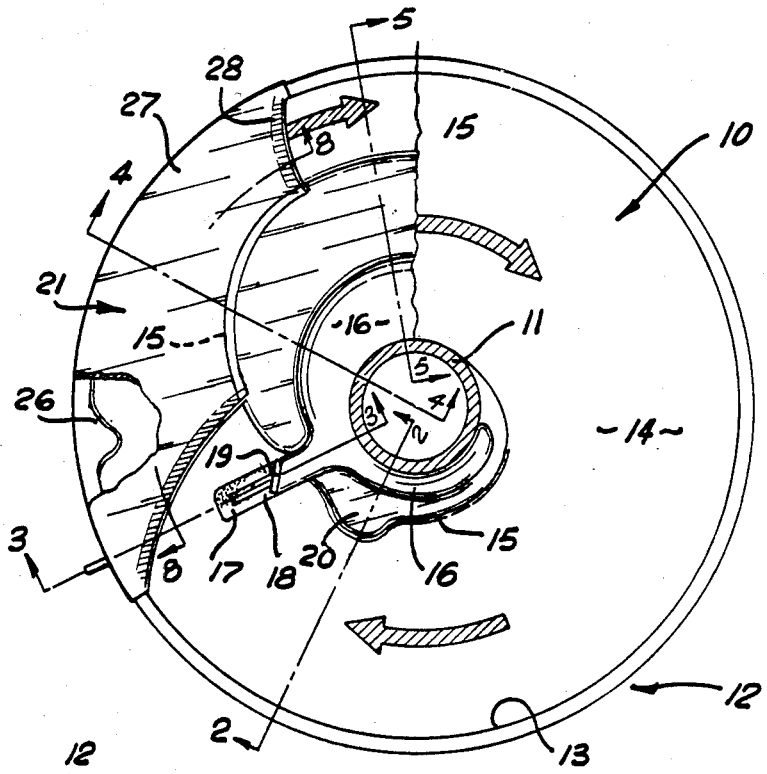
FIG. 1 is a plan view of one turn of a first embodiment of a separator spiral according to the invention.
Figure 2:
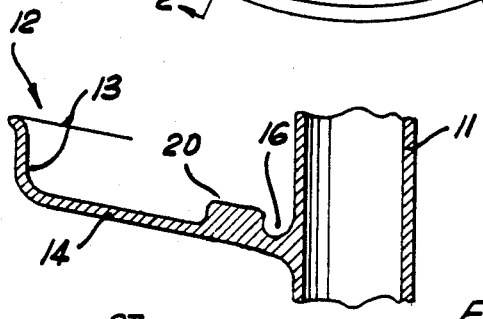
FIGS. 2, 3, 4, 5 and 7 are respective sectional side views taken on lines 2—2, 3—3, 4—4 and 5—5 on FIG. 1 and on line 7—7 of FIG. 6.

The spiral assembly 10 has four similar spirals provided around a substantially vertical central column 11, the upper ends of the spirals being connected to a common feed box containing a supply of pulp from which the concentrate of heavy and/or large species is to be separated. For clarity of description only one spiral is shown in the drawings. In the present example the separator is used to separate a mineral concentrate from a lighter silica sand.

Each spiral 12 has an outer wall 13 connected to a spiral floor 14 which is inclined to the horizontal. For approximately the first turn, the inner wall 15 is fixed to the column 11 and thereafter is spaced from the column by a gutter 16 adapted to convey the separated concentrate to a concentrate outlet (not shown) at the bottom of the spiral. For ease of manufacture, the spirals 12 are preferably formed of fibreglass.

Figure 3:
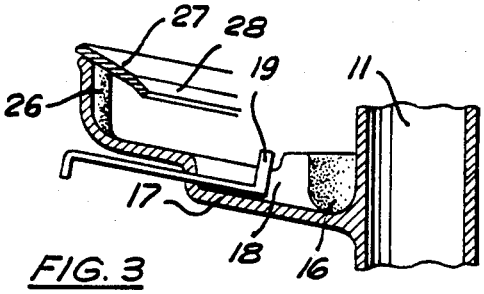
Figure 8:
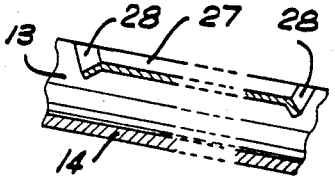
Figure 4:
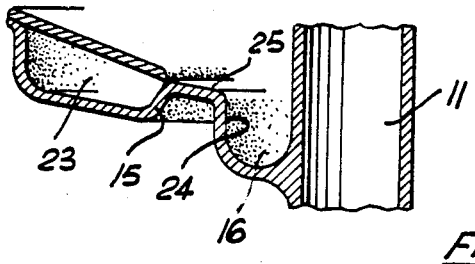
Figure 5:
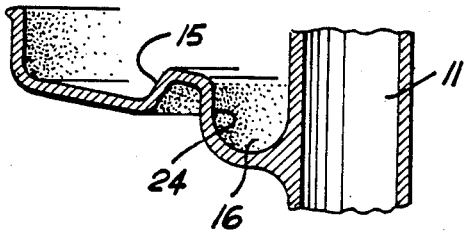

At approximately the second turn of the spiral 12, as shown in FIGS. 1 and 3, a take-off 17, having a transverse slot 18 and movable splitter blade 19, of the type disclosed in Australian Pat. No. 522,914, is provided to convey the concentrate separated from the pulp to the gutter 16, the steep angle of the gutter to the horizontal ensuring that the concentrate will flow freely down the gutter.

A deflector 20, approximately 15–20 mm wide, is provided integrally with the inner wall 15 approximately 50–200 mm upstream of the take-off 17. As shown in FIG. 1 (not to scale), the nose of the deflector is rounded to enable the slurry to flow around the deflector 20 with a relatively smooth flow.

Since water is not compressible, as the slurry flows past the curved deflector 20 not only is the slurry moved outwardly but, in much the same way as a ship moving through the ocean, a wave or "bow wave" is created. The surface of the slurry immediately adjacent the surface of deflector 20 is raised and in seeking its natural level, since the "bow wave" is in the slurry's upper level and in the water containing the silica sand layer partially overlying the concentrate this "bow wave" drives the silica outwardly and further away from the inner wall than the lower band of slurry has been moved outwardly, to leave a clean, albeit wider, band of concentrate. (The width of this band may be increased to e.g. 25 mm downstream of the deflector 20, from a width of e.g. 15 mm upstream of the deflector 20).

The operator, by observing this band, can adjust the splitter blade 19 to take almost all the concentrate. The wider band, free of the silica sand, enables an initial cut of higher grade and yield to be taken than with a conventional spiral.

Figure 6:
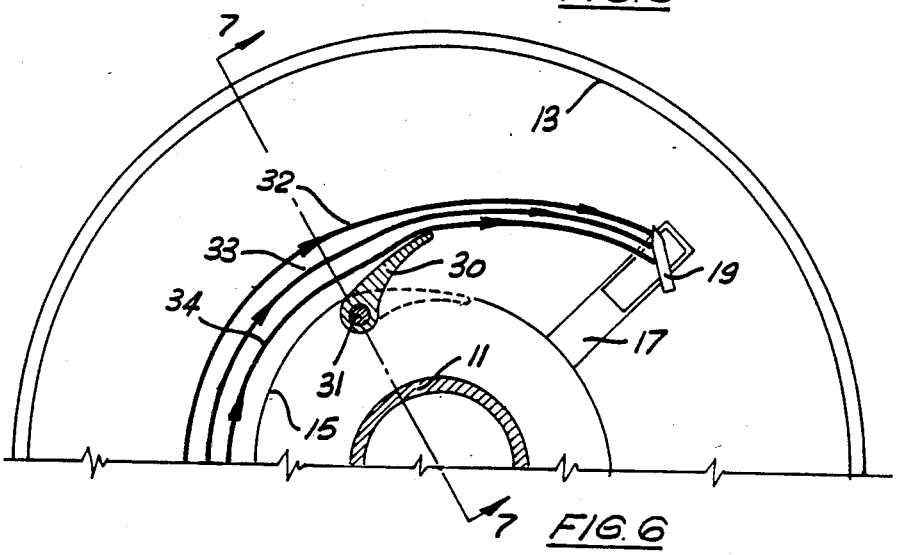
FIG. 6 is a plan view showing part of one turn of a second embodiment according to the invention.
Figure 7:
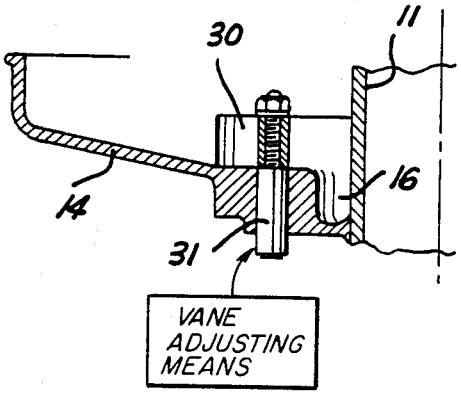

With reference to FIGS. 6 and 7, there is shown schematically a second embodiment in which a first deflector blade 30 is mounted on rod 31 so that the angle of the blade to the direction of flow of slurry is adjustable. Inner wall 15 is provided with a recess whereby blade 30 can be moved out of the stream when not in use. If desired, the height of the lower edge of blade 30 above the trough floor may be made adjustable. The concentrate band in FIG. 6 lies radially inwards of line 32 it being understood that in practice the concentrate band and the band of remainder are not separated by a line. Flow lines 33 and 34 show a bow wave in the vicinity of blade 30.

A repulping assembly is provided just downstream of take-off 17 and consists of a second deflector 22, which is crescent-shaped in plan and, is formed by diverting the inner wall 15 of the spiral outwardly in a smooth curve and then returning it to its initial path to form a restricted width passage 23. The inner wall 15 is connected to a gutter outer wall 24 by a connecting panel 25.

Third deflector 26 is provided integrally with the outer wall 13 just downstream of the take-off 17 and may be of similar width to first deflector 20. A roof section 27, having downturned leading and trailing edges 28, covers the restricted passage 23.

In operation, concentrate is removed via take-off 17. Water moves to the outer wall 13 of the spiral under centrifugal force, while the unseparated remainder comprising tailings and any concentrate remaining in the pulp continue past the take-off 17 adjacent the inner wall 15. The water strikes or impinges against third deflector 26 and is directed inwardly and upwardly against the roof section 27. Simultaneously, the tailings and remaining concentrate are moved outwardly by the second deflector 22, and so are caused to be remixed, or repulped, with the water. The leading and trailing edges 28 of the roof section direct any water striking the downwardly to assist in this mixing process. If preferred, the pitch of the spiral over a short section of the restricted passage 23 may be increased to accelerate the tailings and remaining concentrate to further assist in the mixing process. Downstream of the repulping assembly, the remaining concentrate begins to separate from the tailings and may be taken off into the gutter 16 by a second take-off 17 provided at e.g. the fourth turn, the tailings continuing to a middling and/or tailings outlet (or outlets) at the bottom of the spiral. (These outlets may be of the type disclosed in pending Application No. 55205/80).

To assist in taking off the remaining concentrate, a deflector similar to deflector 20, may be provided upstream of the second take-off. A further deflector, provided e.g. on the third turn of the spiral, may be required to retard the flow of the concentrate down the third and fourth turns of the spiral, otherwise the concentrate reaches a velocity which is such that the centrifugal force on the concentrate moves it outwardly into or over the tailings layer.

Because the spirals are compact, and do not require any additional wash water fittings, and because the repulping assembly ensures the flow of the pulp down the spirals, up to four spirals may be mounted on each column 11.

It will be readily apparent to the skilled addressee that deflectors 20, take-offs 17 and repulping assemblies 21 can be provided on any or all of the spiral turns. However, for effective operation, the pulp must preferably reach a "deflection velocity" where the "bow wave" effect is created to deflect the silica or other gangue, and so generally the first deflector 20 will be provided on the second turn and any subsequent similar deflectors or take-offs approximately every $1\frac{1}{2}$–$2\frac{1}{2}$ turns thereafter, with retarding deflectors (if necessary) to control the upper limit of the pulp velocity intermediate the take-offs. Experiments to date have shown best results have been obtained using spirals with five or six turns, the first deflector 20 and take-off 17 being provided on the second turn, a retarding deflector on the third turn, and a second deflector 20 and take-off 17 on the fourth turn and a repulping assembly 21 on the second turn.

Where high grade mineral is being separated from the pulp, it can be observed that the gangue or silica only overlies the outer portion of the concentrate. To disturb the concentrate flow as little as possible, the first deflector 20 (and subsequent deflectors) may be spaced outwardly from the inner wall to provide an undisturbed path for the inner portion of the slurry. The outer portion is deflected, as hereinbefore described, but the concentrate flows inwardly to fill the void downstream of the deflector as the gangue or silica is deflected outwardly to produce a purer stream of concentrate downstream of the deflector. The deflector may be movable across the spiral to suit the particular mineral being separated from the pulp.

If preferred a vane shaped deflector may be used and this may be pivotally mounted.

The size, shape and position of the repulping assemblies will be dictated by the nature of the pulp to be separated and the pitch of the spirals. It will be readily apparent that the design of the repulping assembly will preferably ensure a good flow of the pulp down the spiral to enable high feed rates to be fed to the spirals, while ensuring adequate repulping of the water and tailings to ensure continuity of flow of same down the spirals, with as little disturbance of the partially separated concentrate as is possible. In certain applications, e.g. the separation of high grade mineral at lower feed rates, it may be preferred to allow a portion of the wash water to flow over the third deflector 26 to prevent excessive turbulence being generated in the repulping assemblies. In these applications the deflector may extend up only a portion of the height of the outer wall 13. Where the spirals are to be used to separate minerals of different grades and/or feed rates, the height of the deflector may be made adjustable. For example, the deflector may have a fixed lower portion formed integrally with the wall and an inner, telescopic portion, which may be raised or lowered to adjust the height operated by a suitable control stick, rod or bar.

The previously known methods of facilitating the flow of pulp down the spirals by the adding or injection of washwater involved supplementary plumbing means. The washwater is a constant source of operating and other problems such as algae growth in the distribution tubes and the need for adjustment of up to five taps per spiral start. The water has to be finely screened to remove extraneous trash and is costly to supply, and the distribution equipment is troublesome to maintain in good working order. The addition of the wash water to the pulp also creates bin overflow problems.

The present invention of repulping with the water contained in the initial feed is substantially costless and operator free.

To an extent which will be apparent to those skilled in the art from the teachings hereof, various changes and modifications may be made to the design and construction of the spiral separators without departing from the present invention.

I claim:

1. A spiral separator for an aqueous slurry separation of varying specific gravity or sizes of a concentrate of said slurry from a remainder of said slurry in which a band of said remainder partially overlies a concentrate band having a helical trough including an inner wall and an outer wall connected by a floor and having at least one take-off opening for a concentrate species separated from a remainder of the slurry, said separator including deflection means arranged upstream of said take-off opening for diverting said band of the remainder in an outward direction relative to the concentrate band.

2. A separator according to claim 1 wherein the deflection means comprises a deflector at the inner wall flow.

3. A separator according to claim 2 wherein the deflection means is integral with the inner wall, and of a shape which at a deflection velocity of slurry flow produces a wave in which the top part of the wave moves at a greater speed than the part beneath it and which urges the overlying remainder in a radially outward direction.

4. A separator according to claim 1 wherein the deflection means comprises a vane at or near the inner wall and extending transverse the downward direction of slurry flow.

5. A separator according to claim 4 wherein the vane is pivotally mounted.

6. A separator according to claim 1 wherein the slurry is horizontally layered and the deflection means comprises a vane adapted to direct an upper layer of the slurry which is comprised of said remainder in an outward direction and having an underlying passage whereby to permit a relatively undeflected flow of a lower layer of the slurry which is comprised of said concentrate.

7. A separator according to claim 6 including means for adjusting the height above the trough floor of a lower edge of the vane.

8. A separator according to claim 1 wherein the deflection means is situated between 50 and 200 millimeters upstream from a splitter or take-off.

9. A method for separating a slurry containing a first species from a second species having a specific gravity less than the first species comprising the steps of:

(a) feeding a slurry of the first and second species down the trough of a spiral separator having an inner wall and an outer wall connected by a floor whereby the slurry forms an inner band in which one of the species is concentrated and and outer band in which it is depleted, at least a portion of siad depleted outer band overlying the concentrated inner band;

(b) diverting at least the inner part of the overlying depleted band outwardly relative to the underlying concentrated inner band at a location upstream from a take-off opening;

(c) taking off said first species at said opening.

10. A method according to claim 9 wherein the overlying depleted band is deflected by deflecting a flow of slurry of the first and second species in an outwards direction, said deflected flow urging the overlying depleted band outwardly relative to the underlying concentrated inner band of concentrate.

11. A method according to claim 10 wherein the outward flow is a result of impingement of the slurry of the first and second species on deflector means situated inwardly of the depleted band at a sufficient slurry flow velocity to form a wave in which the top part of the wave moves at a greater speed than the part beneath it.

12. A method according to claim 9 wherein the overlying depleted band is deflected outwardly relative to the underlying concentrated inner band by means of a deflector blade deflecting the overlying depleted band of the slurry stream outwardly and permitting the underlying cencentrated inner band of the slurry stream to pass substantially undeflected.

13. A method according to claim 9 wherein the slurry of the first and second species at or adjacent the inner wall is deflected in an outwards direction causing the inner concentrated band to fan out in width upstream from the take-off opening.

* * * * *